United States Patent [19]

Daugirda et al.

[11] 4,452,226

[45] Jun. 5, 1984

[54] WATER HEATER TANK ASSEMBLY

[75] Inventors: Paul G. Daugirda, Evergreen Park, Ill.; Keith R. Clark, Montgomery, Ala.

[73] Assignee: Rheem Manufacturing Company, New York, N.Y.

[21] Appl. No.: 427,530

[22] Filed: Sep. 29, 1982

[51] Int. Cl.[3] ..... F24H 1/04

[52] U.S. Cl. ..... 126/373; 126/363; 248/188; 248/188.8; 248/188.9

[58] Field of Search ..... 126/373, 363; 122/510; 248/128, 146, 188, 188.8, 188.9, 677

*Primary Examiner*—James C. Yeung

*Assistant Examiner*—Helen Odar

*Attorney, Agent, or Firm*—Allegretti, Newitt, Witcoff & McAndrews, Ltd.

[57] ABSTRACT

An improved water heater tank leg support assembly includes a plurality of legs formed from a generally rectangular blank by bending the sides of the blank to form a shearing action vertical support member which is spaced by the base. A boss or depression in the base supports the leg member above the floor. The base engages a pan which is suspended beneath a water heater tank. The upstanding vertical legs of the leg support the water heater tank itself.

4 Claims, 10 Drawing Figures

WATER HEATER TANK ASSEMBLY

BACKGROUND OF THE INVENTION

This invention relates to an article of manufacture; namely, a water heater tank construction and more particularly to the improvment in such a construction of a novel leg design which supports a water heater tank.

Typically a water heater tank is formed with a vertical, cylindrical tank wall having a top cap and a bottom, generally dished wall. The tank is typically supported upon a base or base pan, for example by plastic legs. The legs serve a dual function of supporting the tank and supporting the base. The base pan also supports a jacket which surrounds the tank. Usually, an insulation material is positioned between the jacket and tank.

It is desirable to use as few a number of parts in the construction of such a water heater as possible. It is also desirable to provide that such parts will be fabricated and then fit together with as few mechanical and assembly operations as possible. With these objectives in mind, the present invention was conceived.

SUMMARY OF THE INVENTION

Briefly, the present invention comprises an improvement in a water heater tank assembly of the type including a water heater tank supported on legs with respect to a base plate or base wherein the base plate also supports a jacket which surrounds the tank. Specifically, the invention relates to an improved leg construction. The improved leg construction is fabricated from sheet metal and includes a horizontal planar center section and connected, opposed, vertical side sections with a boss or depression defined in the center section. The leg is stamped or formed from a sheet of metal. The vertical sections of the leg are designed to shear the metal forming the base or base pan during the pan assembly operation thereby eliminating the need to cut slots for receipt of the legs. Additionally, the legs are so constructed as to inhibit or prevent sliding of the legs or removal of the legs from the base pan.

Thus, it is an object of the invention to provide an improved water heater tank assembly construction and more particularly a water heater tank assembly construction having the improvement of support legs for supporting a water heater tank upon a lower base pan.

A further object of the present invention is to provide an inexpensive, easy to manufacture and simple method of manufacture of a leg support for a water heater tank.

A further object of the present invention is to provide a leg support for a water heater tank which may be used and assembled with a pan or base without extra cutting, punching or other machining operations in order to effect attachment of the leg support to the base.

Still a further object of the present invention is to provide a leg support for a water heater tank which is durable, and which remains attached to the base pan for the tank without slippage or other undesirable movement.

These and other objects, advantages and features of the invention will be set forth in the detailed description which follows.

BRIEF DESCRIPTION OF THE DRAWINGS

In the detailed description which follows, reference will be made to the drawing comprised of the following figures.

DESCRIPTION OF THE PREFERRED EMBODIMENT

Figure 1:
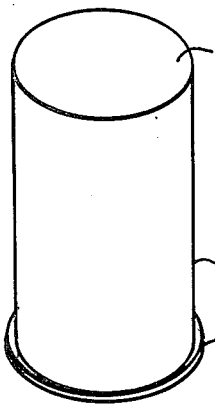
FIG. 1 is a perspective view of a water heater tank on a base or pan.

FIGS. 2–5 illustrate a prior art construction. FIG. 1 illustrates a typical water heater storage tank assembly which may utilize the prior art support assembly as depicted by FIGS. 2–5 or may use the support assembly of the present invetion as depicted by FIGS. 6–10.

Referring first to the prior art assembly, a water heater tank 14 typically includes a cylindrical shell 15 and a concave base 17 which is attached by welding, for example, to the shell 15. The top of the tank 14 may comprise a welded cap 19.

The tank 14 is surrounded by a jacket 12. Insulation may be installed in the space between the tank 14 and jacket 12. The jacket 12 is supported on a base or pan 10. That is, the lower edge of the outer jacket 12 is crimped to form a flange 11 which cooperates with a side flange 21 of the pan 10 to support the jacket 12.

Figure 2:
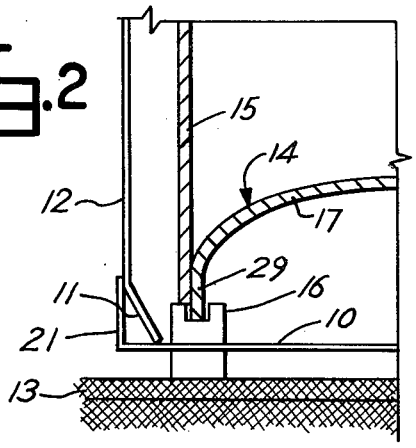
FIG. 2 is a side cross sectional view of a prior art water tank support construction.
Figure 3:
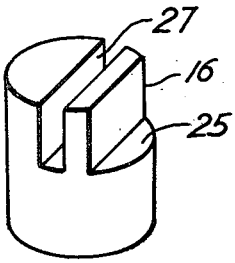
FIG. 3 is an enlarged perspective view of the support leg associated with the prior art construction of FIG. 2.
Figure 4:
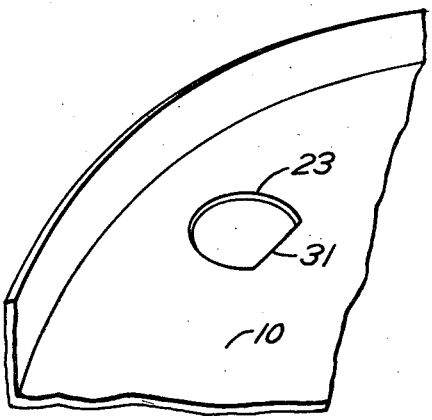
FIG. 4 is a perspective view of the support pan associated with the construction of FIG. 2.
Figure 5:
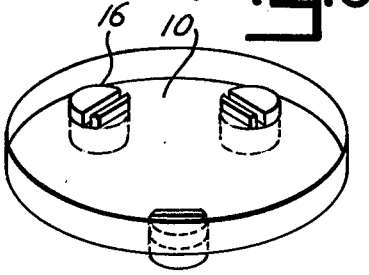
FIG. 5 is a perspective view of the subassembly of support legs and support pan as shown in FIG. 2.

A plurality of specially formed plastic leg supports 16, as depicted in FIG. 3, fit through punched openings 23 in the pan 10 as shown in FIGS. 4 and 5. The legs 16 include a flange surface 25 which cooperates with the base of pan 10 to support the pan 10. The passage or opening 23 through the pan 10 includes a flat side 31 which serves to properly orient the leg 16 and also defines a portion of the pan 10 cooperate with the flange surface 25. The legs 16 also include a through slot 27 which receives circumferential lower flange 29 of the tank 14. In this manner the tank 14 is supported as shown in FIG. 2.

Figure 6:
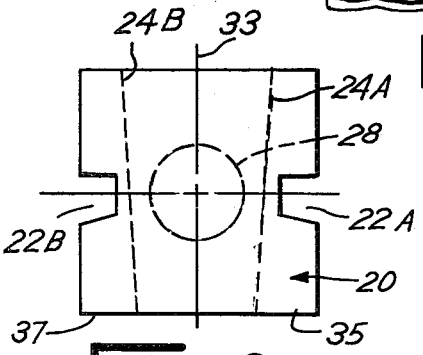
FIG. 6 is a top plan view of the blank form for the improved support leg of the present invention.

FIGS. 6–10 illustrate the improved construction of the present invention. FIG. 6 illustrates the improved leg assembly of the present invention as it is formed from a blank sheet of metal, for example. Referring therefore to FIG. 6, leg support 20 is formed from a rectangular piece of sheet metal. Bend lines 24A and 24B are skewed with respect to a longitudinal axis 33. Thus, if the bend lines 24A and 24B were extended, they would ultimately intersect.

Figure 8:
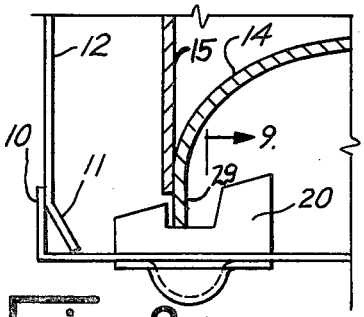
FIG. 8 is a side cross sectional view of the water heater tank and support assembly of the present invention.
Figure 9:
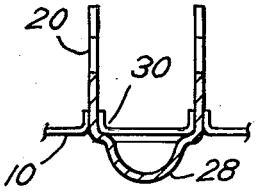
FIG. 9 is a side cross sectional view taken substantially along the line 9—9 in FIG. 8.

The section of the leg support 20 between the bend lines 24A and 24B is a generally planar horizontal section 26 in the final leg support. A boss or depression 28 is formed at the center of the section 26 and extends downwardly in a vertical direction as shown in FIGS. 8 and 9. The sections 35, 37 on the outside of the bend lines 24A and 24B define vertically upstanding transverse support sections 35 and 37. Notches 22A and 22B are formed in the upstanding sections 35 and 37, respectively. The notches 22A, 22B may be formed in any manner to accommodate the particular water heater tank which is to cooperate with the leg supports 20.

Figure 7:
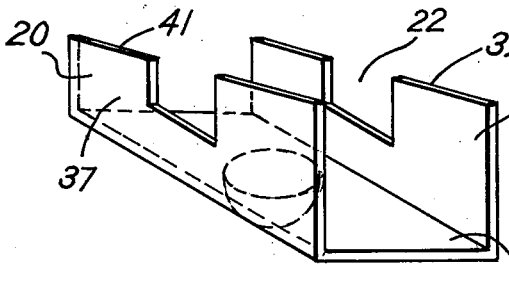
FIG. 7 is a perspective view of the support leg of FIG. 6 as assembled.

The assembled or formed leg support as shown in FIG. 7 and more particularly the top edges 39 and 41 of the vertical sections 35 and 37 respectively define a shear surface which, when mechanically pressed against the bottom of pan or base 10, will cut through or shear a slot into the pan 10. Thus, prepunching of the base or pan 10 is not required. Also, since the bend lines 24A and 24B are skewed, the leg support 20 is substantially locked into position upon insertion through the bottom of the pan 10 as shown in FIGS. 9 and 10.

Figure 10:
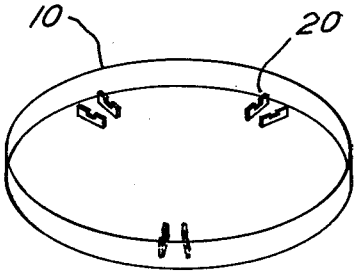
FIG. 10 is a perspective view of the support pan and support leg subassembly in the embodiment of the invention depicted in FIG. 8.

Referring to FIGS. 9 and 10, the leg supports 20 are arranged symmetrically about the bottom or center of the pan 10. The bend lines 24A and 24B may be aligned to intersect at the very center of the pan 10. The leg support 20 is spaced from the outside edge 21 of the pan 10 so that the crimped flange 11 will have appropriate room in which to be inserted into the pan 10. The notches 22A and 22B of each leg support cooperate with the lower edge 29 of the tank 14 and thus support the tank as shown in FIG. 8. It is noted, however, that the supports 20 may be positioned in any desired location and orientation. Importantly, the tank 14 is supported directly by leg supports 20 above the pan 10 thereby providing continuity for conduction and also improving thermal insulation. Support above pan 10 is effected by controlling the depth of notches 22A and 22B.

The nonparallel sides 35, 37 provide a wedge-type resistance to horizontal thrusts that may occur in subsequent assembly or shipment of the tank 14. The bends 24A and 24B, since they are skewed, provide the dual advantage of forming the wedge shape as described and also insuring that a shearing edge or angled shear surface 39, 41 will be formed from the generally rectangular blank as shown in FIG. 6. When the shearing surface 39, 41 cuts through pan 10, extruded sections 30 are formed which resist withdrawal or extraction of the leg support 20. It is possible to vary the construction and configuration of the leg support by varying, for example, the shape of the notch 22, the number and size of depressions 25, the angle of the bend lines 24A and 24B and by making various other modifications. The subject matter of the invention is therefore to be limited only by the following claims and their equivalents.

What is claimed is:

1. In a water heater of the type including a storage tank having a lower edge, a jacket surrounding the storage tank, a base, support means for maintaining the storage tank lower edge in spaced relation to the base and supported by the base, said jacket also being supported by the base, the improvement comprising, in combination:

improved support means, said support means comprising a plurality of formed leg members, each leg member including a generally planar, horizontal run, and a generally transverse vertical run extending from the horizontal run, said horizontal run also including a boss projecting vertically in the opposite direction from the transverse run, said transverse run formed with an upper edge surface inclined relative to the horizontal to define a shear member for cutting through the base upon assembly with the base, said transverse run also including a notch for receipt of and support of the lower edge of the tank, and said horizontal run positioned beneath the base so that the vertical run cuts through and projects through the base.

2. The improvement of claim 1 wherein each leg member is comprised of two identical vertical runs spaced from each other and connected to the outside edges of the horizontal run.

3. The improvement of claim 2 wherein each of said vertical runs for each leg member is skewed.

4. The improvement of claim 1 wherein each of said leg members is spaced an equiradial distance from the center of the tank.

* * * * *

UNITED STATES PATENT AND TRADEMARK OFFICE

CERTIFICATE OF CORRECTION

PATENT NO. : 4,452,226

DATED : June 5, 1984

INVENTOR(S) : PAUL G. DAUGIRDA et al.

It is certified that error appears in the above-identified patent and that said Letters Patent is hereby corrected as shown below:

In the Description of the Preferred Embodiment, column 4, line 5, the number corresponding to the depression is mistyped.

Delete "25", and insert --28--.

Signed and Sealed this

*Twenty-second* Day of *October 1985*

[SEAL]

*Attest:*

DONALD J. QUIGG

*Attesting Officer*

*Commissioner of Patents and Trademarks—Designate*